US007329810B2

(12) United States Patent
Spivack et al.

(10) Patent No.: US 7,329,810 B2
(45) Date of Patent: Feb. 12, 2008

(54) CYMBAL CRASH APPARATUS

(75) Inventors: Larry Spivack, 900 W. 190th St., Apt. 1B, New York, NY (US) 10040; Noah David Hwang, Brooklyn, NY (US); Glen Ayers, West Caldwell, NJ (US)

(73) Assignee: Larry Spivack, New York, NY (US)

( * ) Notice: Subject to any disclaimer, the term of this patent is extended or adjusted under 35 U.S.C. 154(b) by 0 days.

(21) Appl. No.: 11/255,984

(22) Filed: Oct. 24, 2005

(65) Prior Publication Data

US 2006/0086233 A1 Apr. 27, 2006

Related U.S. Application Data

(60) Provisional application No. 60/621,538, filed on Oct. 25, 2004.

(51) Int. Cl.
*G10D 13/02* (2006.01)

(52) U.S. Cl. ..... 84/422.1

(58) Field of Classification Search ..... 84/422.1, 84/422.2, 422.3

See application file for complete search history.

(56) References Cited

U.S. PATENT DOCUMENTS

| | | | | |
|---|---|---|---|---|
| 238,465 | A | 3/1881 | White | |
| 792,080 | A | 6/1905 | Rue | |
| 1,613,978 | A | 1/1927 | Berton | |
| 1,643,553 | A | 9/1927 | Gladstone | |
| 3,742,810 | A | 7/1973 | Crigger | 84/422 |
| 4,111,095 | A * | 9/1978 | Simons | 84/422.3 |
| 4,177,709 | A * | 12/1979 | Adams | 84/422.3 |
| 4,510,838 | A * | 4/1985 | Alexis, Jr. | 84/422.3 |
| 4,905,565 | A | 3/1990 | Hoshino | 84/422.3 |
| 5,063,819 | A | 11/1991 | Hoshino | 84/422.3 |
| 5,367,939 | A | 11/1994 | Barker | 84/402 |
| 6,054,645 | A * | 4/2000 | Gauger | 84/422.3 |
| 6,747,200 | B2 | 6/2004 | Sato | 84/422.3 |

* cited by examiner

*Primary Examiner*—Kimberly Lockett
(74) *Attorney, Agent, or Firm*—Steptoe & Johnson LLP

(57) ABSTRACT

A percussion instrument includes a stand, an operating rod defining a first axis, a foot pedal operably associated with the operating rod for permitting movement of the operating rod along the first axis, and a pair of movable arms coupled to the stand. A first rigid vibrator is disposed on one of the arms and a second rigid vibrator is disposed on the other of the arms. A clutch is coupled to the arms for governing movement thereof, wherein the arms are rotatable toward each other and toward the first axis.

21 Claims, 8 Drawing Sheets

CYMBAL CRASH APPARATUS

CROSS-REFERENCE TO RELATED APPLICATIONS

The benefits of Provisional Application No. 60/621,538 filed Oct. 25, 2004 are claimed under 35 U.S.C. § 119(e), and the entire contents of this application are expressly incorporated herein by reference thereto.

FIELD OF THE INVENTION

The invention relates to a percussion instrument. More particularly, the invention relates to pivotably supported cymbals.

BACKGROUND OF THE INVENTION

A hi-hat is a popular percussion instrument that has found acceptance in a wide variety of musical applications including jazz and rock and roll and in a variety of venues including concert halls and marching band events. The hi-hat includes a pair of cymbals that are movable with respect to each other, with movement controlled by actuation of a foot pedal. A drumstick or brush often is used in conjunction with the cymbals to create a desired sound.

A prior art hi-hat stand 10 is shown in FIG. 1. Stand 10 has an upper movable cymbal 11, a lower stationary cymbal 11*a*, an internal, longitudinally movable support pipe 12 that supports the lower stationary cymbal 11*a*, and an external stationary tube 14 around the pipe 12 and supported on a tripod 13. A foot pedal 16 is connected to the lower end of an operating rod 17, which in turn is connected to upper cymbal 11. Pedal 16 moves operating rod 17 and upper cymbal 11 up and down. Operating rod 17 is coaxially and internally disposed with respect to support pipe 12 as well as slidable with respect thereto. Thus, foot pedal 16 operates movable cymbal 11 against stationary cymbal 11*a*. A cymbal receiving support 20 for stationary lower cymbal Ha is provided on top of pipe 12. Lower stationary cymbal 11*a* is maintained to face open upward while upper movable cymbal 11 faces open downward and opposes stationary lower cymbal 11*a*. Upper movable cymbal 11 may be urged away from lower stationary cymbal 11*a* by a spring (not shown) on or near to and connected to operating rod 17.

A clutch may be used to control the height of the upper cymbal coupled to the operating rod.

A variety of devices are known for linking foot pedal 16 to upper cymbal 11, as disclosed for example in U.S. Pat. Nos. 4,905,565 and 6,747,200 B2. As explained therein, operating rod 17 may be directly connected with foot pedal 16 using a chain, or alternatively operating rod 17 and foot pedal 16 may be connected using a rotary member that utilizes a differential lever operation principle.

Many other devices are known for operably associating a pair of cymbals. For example, U.S. Pat. No. 238,465 to White is directed to a toy cymbal in which a pair of miniature cymbals are strung or mounted loosely on a cord attached to a handle. When the handle is shaken, the cymbals contact one another by sliding on the cord. Other hand-held or hand-actuated cymbal pairs are disclosed in U.S. Pat. No. 792,080, U.S. Pat. No. 1,643,553 and U.S. Pat. No. 5,367,939. Another device disclosed in U.S. Pat. No. 1,613,978 to Berton includes a floor engaging base section having a cymbal mounted on an upper surface thereof, a treadle hingedly connected in overlying relation to said base section and having a cymbal mounted on its under surface, and a foot strap secured to the treadle for movement of the cymbals with respect to one another. Yet another instrument design incorporating a pair of cymbals is disclosed in U.S. Pat. No. 3,742,810 to Crigger directed to an angularly adjustable cymbal mounting.

Despite these developments, there remains a need for a percussion apparatus in which a pair of cymbals are supported in a pivotable manner and may be actuated by a foot pedal. There further remains a need for a pair of cymbals that may be supported in a generally vertical manner and at a substantial height above a foot-actuated pedal.

SUMMARY OF THE INVENTION

The invention relates to a percussion instrument that includes a stand, an operating rod defining a first axis, a foot pedal operably associated with the operating rod for permitting movement of the operating rod along the first axis, and a pair of movable arms coupled to the stand. A first rigid vibrator is disposed on one of the arms and a second rigid vibrator is disposed on the other of the arms. A clutch is coupled to the arms for governing movement thereof, wherein the arms are rotatable toward each other and toward the first axis.

The rigid vibrators may be pivotable to contact each other proximate the first axis, and the first axis may be generally vertical. Also, the rigid vibrators may be mounted proximate ends of the arms. The clutch may be demountably attached to the operating rod, and the clutch may be movable along the first axis to permit the arms to pivot with respect thereto. The arms may be coupled to the stand with elastic members that may be elastic cords. In some embodiments, the arms may be coupled to the operating rod with rigid members. In addition, the stand may include a tube through which the operating rod is received, and the movable arms may be coupled to the tube. In some embodiments, the rigid vibrators may be cymbals.

The invention further relates to a percussion instrument that includes a stand, an operating rod defining a generally vertical first axis, and a foot pedal operably associated with the operating rod for permitting movement of the operating rod along the first axis. A pair of movable arms may be coupled to the stand, with a first cymbal disposed on one of the arms and a second cymbal disposed on the other of the arms. A clutch may be coupled to the arms for governing movement thereof, and the arms may be pivotable toward each other and toward the first axis so that the cymbals are permitted to engage each other proximate the first axis.

A first elastic member may be provided for resisting movement of one of the movable arms toward the first axis and a second elastic member may be provided for resisting movement of the other of the movable arms toward the first axis. In addition, the stand may include a tube through which the operating rod is received. A support may be fixed to the tube, wherein the arms are pivotable with respect to the support. The arms may include first and second portions, with the first portion pivotably coupled to the support and the second portion generally perpendicular to the first portion. The clutch may include at least one pivot axis and at least one arm may be pivotable with respect to the at least one pivot axis.

Moreover, the invention relates to a percussion instrument including a floor stand, an operating rod defining a first axis, a foot pedal for actuating movement of the operating rod along the first axis, a pair of pivotable arms supported by the floor stand, and a cymbal coupled to each arm, wherein the arms are coupled to the operating rod and pivotable toward each other and toward the first axis so that the cymbals are permitted to engage each other. The foot pedal may be operable in a first direction for moving the operating rod to move the cymbals toward one another, and the foot pedal may be movable in a second direction opposite from the first direction for moving the operating rod to move the cymbals away from one another. The arms may be biased away from each another.

BRIEF DESCRIPTION OF THE DRAWINGS

Preferred features of the present invention are disclosed in the accompanying drawings, wherein.

DETAILED DESCRIPTION OF THE PREFERRED EMBODIMENTS

Figure 1:
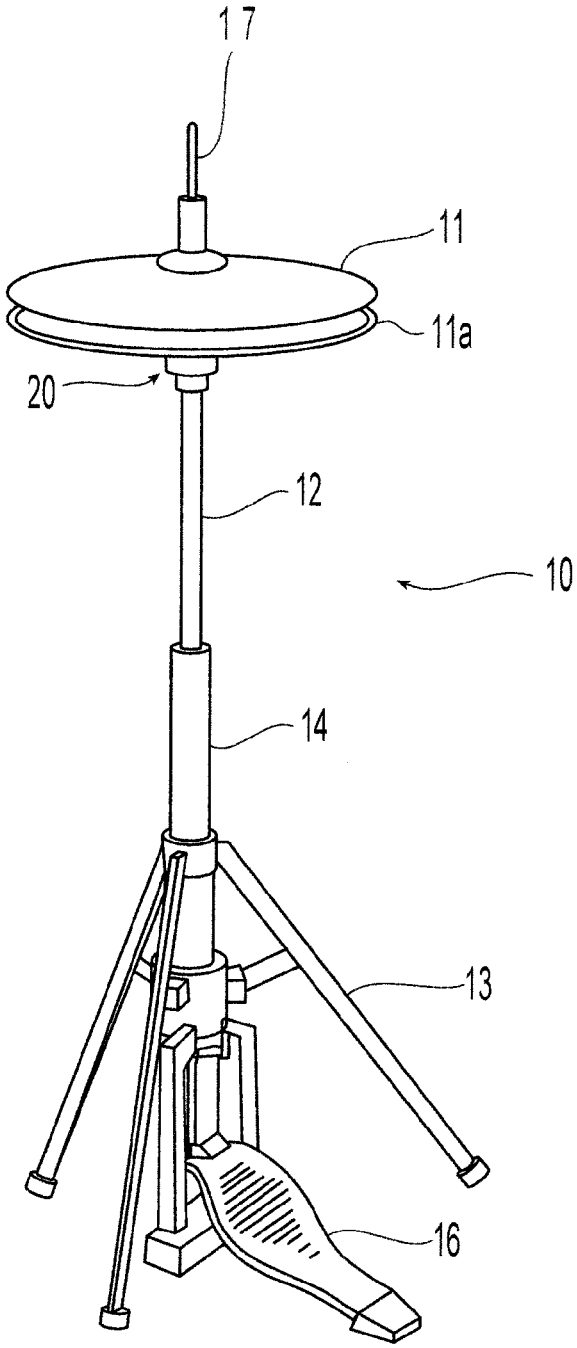
FIG. 1 (Prior Art)
FIG. 1 shows a side perspective view of a prior art hi-hat assembly.
Figure 2:
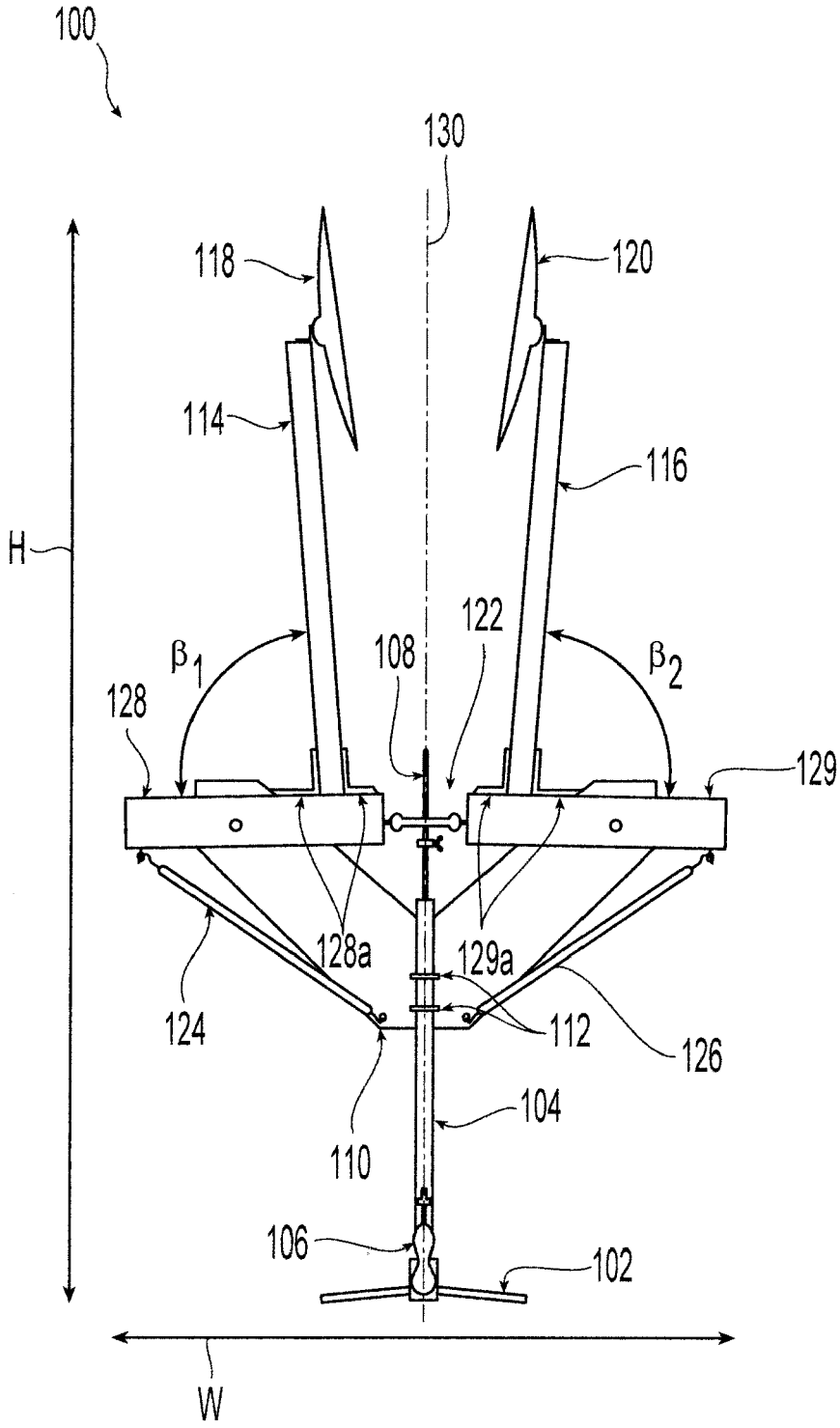
FIG. 2 shows a front view of a first embodiment of a cymbal assembly according to the present invention.

Referring to FIG. 2, a preferred exemplary embodiment of a cymbal assembly 100 according to the present invention is shown. Assembly 100 includes a stand 102 which may be in the form of a tripod, with an external stationary tube 104 coupled thereto. A foot pedal 106 is connected to the lower end of an operating rod 108, as known in the prior art and previously described. Operating rod 108 is coaxially and internally disposed with respect to stationary tube 104 as well as longitudinally slidable therein. Pedal 106 moves operating rod 108 up and down. A support 110 is coupled to stationary tube 104, and preferably is generally V-shaped and attached to tube 104 with a plurality of U-bolts 112. A pair of arms 114, 116 are pivotably associated with support 110, as will be described below. Arms 114, 116 are disposed in a generally vertical fashion. Cymbals 118, 120 are coupled to arms 114, 116, respectively, proximate free ends thereof. Also, a coupling portion 122 is associated with arms 114, 116 and operating rod 108 to permit movement of cymbals 118, 120 with respect to each other. Elastic retaining members 124, 126 further couple pivot portions 128, 129 to support 110, and bias pivot portions 128, 129 in a pivot position on support 110 such that cymbals 118, 120 do not contact one another.

In one preferred exemplary embodiment, assembly 100 preferably has a width W of between about 35 inches and about 50 inches, more preferably between about 40 inches and about 46 inches, and most preferably about 43 inches. Furthermore, in one preferred exemplary embodiment assembly 100 preferably has a height H of between about 60 inches and about 90 inches, more preferably between about 70 inches and 82 inches, and most preferably about 76 inches. Also, pivot portions 128, 129 each preferably are disposed at fixed angles $\beta_1$, $\beta_2$ with respect to arms 114, 116, respectively. Angles $\beta_1$, $\beta_2$ preferably are about 90°, although in alternate embodiments angles $\beta_1$, $\beta_2$ may not be the same and may be set at angles other than 90° such as between about 80° and 110°. Brackets 128*a*, 129*a* may be used to secure pivot portions 128, 129 to arms 114, 116, respectively.

Figure 3A:
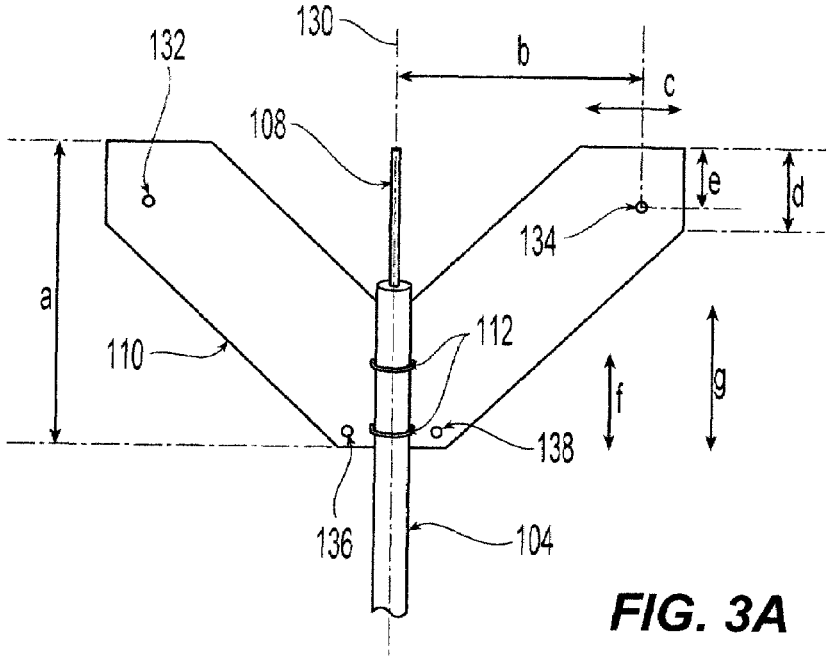
FIG. 3 shows the connection of a support to a tube of FIG. 2, including (3A) a front view thereof, (3B) a back view thereof, and (3C) a U-bolt for use therewith.
Figure 3B:
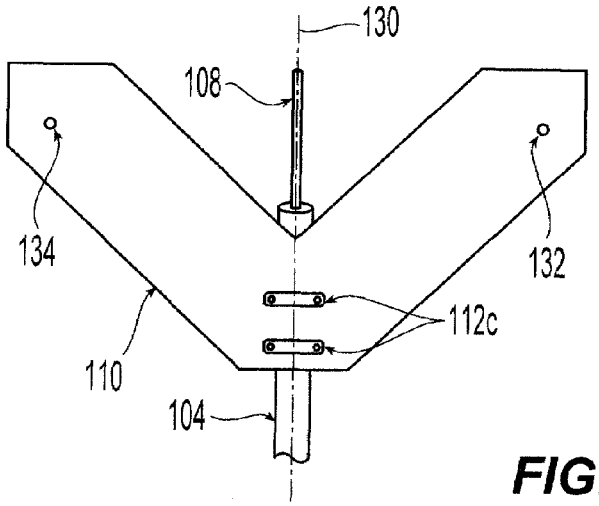
Figure 3C:
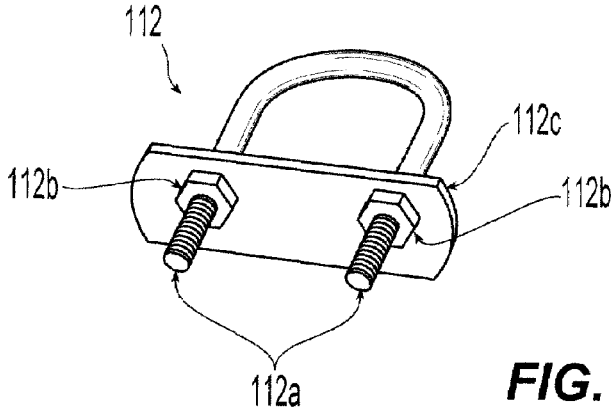

Turning to FIGS. 3A-3C, the connection of support 110 to tube 104 will be described along with a preferred sizing of support 110. As previously discussed, a pair of U-bolts 112 retain support 110 against tube 104. As shown in FIG. 3C, rounded U-bolts 112 include threaded end portions 112*a* that threadably receive nuts 112*b*, along with a bracket 112*c*. The threaded end portions 112*a* of each U-bolt 112 extend through support 110, so that brackets 112*c* may be fixed against support 110 by pressure applied by nuts 112*b*. Preferably, U-bolts 112 are disposed along a central axis 130 of support 110. In one exemplary embodiment, 2.5 inch U-bolts 112 are employed.

A pivot hole 132, 134 is provided in support 110 for each pivot portion 128, 129, and eyebolts 136, 138 also may be used for attachment to retaining members 124, 126, respectively. Preferably, eyebolts 136, 138 are spaced at least 0.5 inch from the perimeter of support 110.

Thus, as shown in FIG. 2, pivot portions 128, 129 may be pivotably coupled at holes 132, 134 of support 110, such as by smooth bolt connections extending through like-aligned holes in pivot portions 128, 129.

Dimensions of an exemplary preferred embodiment of support 110 are as follows: a of about 17 inches, b of about 13.75 inches, c of about 5.5 inches, d of about 5 inches, e of about 3.25 inches, f of about 4 inches, and g of about 7.5 inches.

Figure 4A:
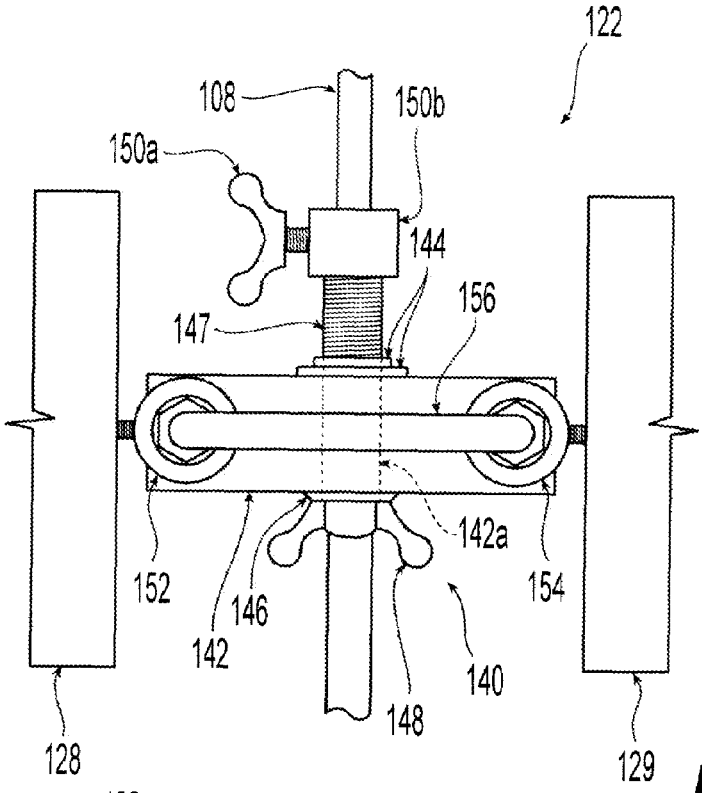
FIG. 4 shows a clutch assembly of FIG. 2, including (4A) a front view, (4B) a top view, and (4C) a partial front perspective view.
Figure 4B:
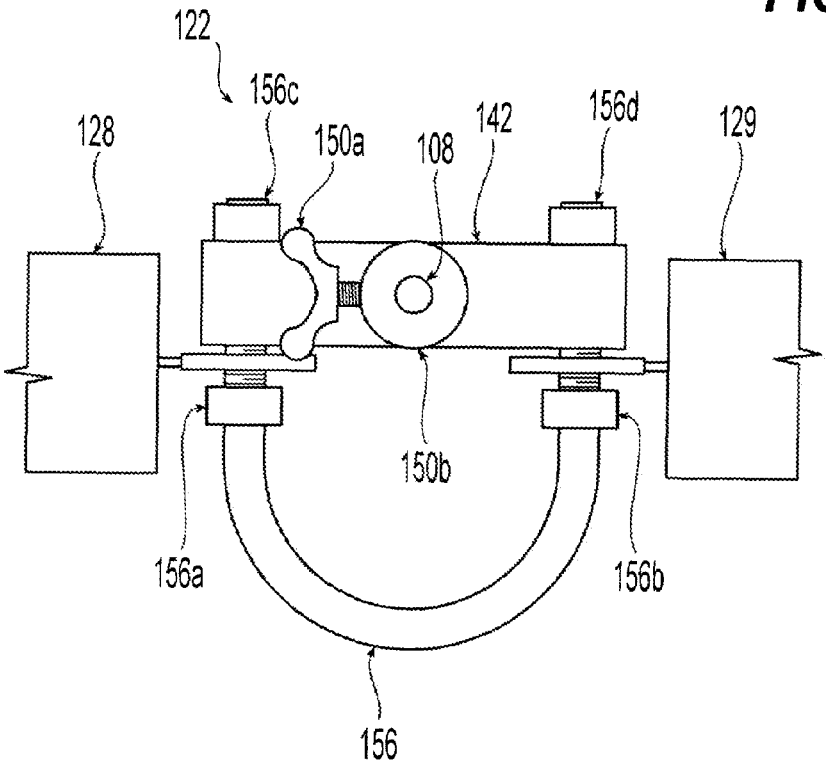
Figure 4C:
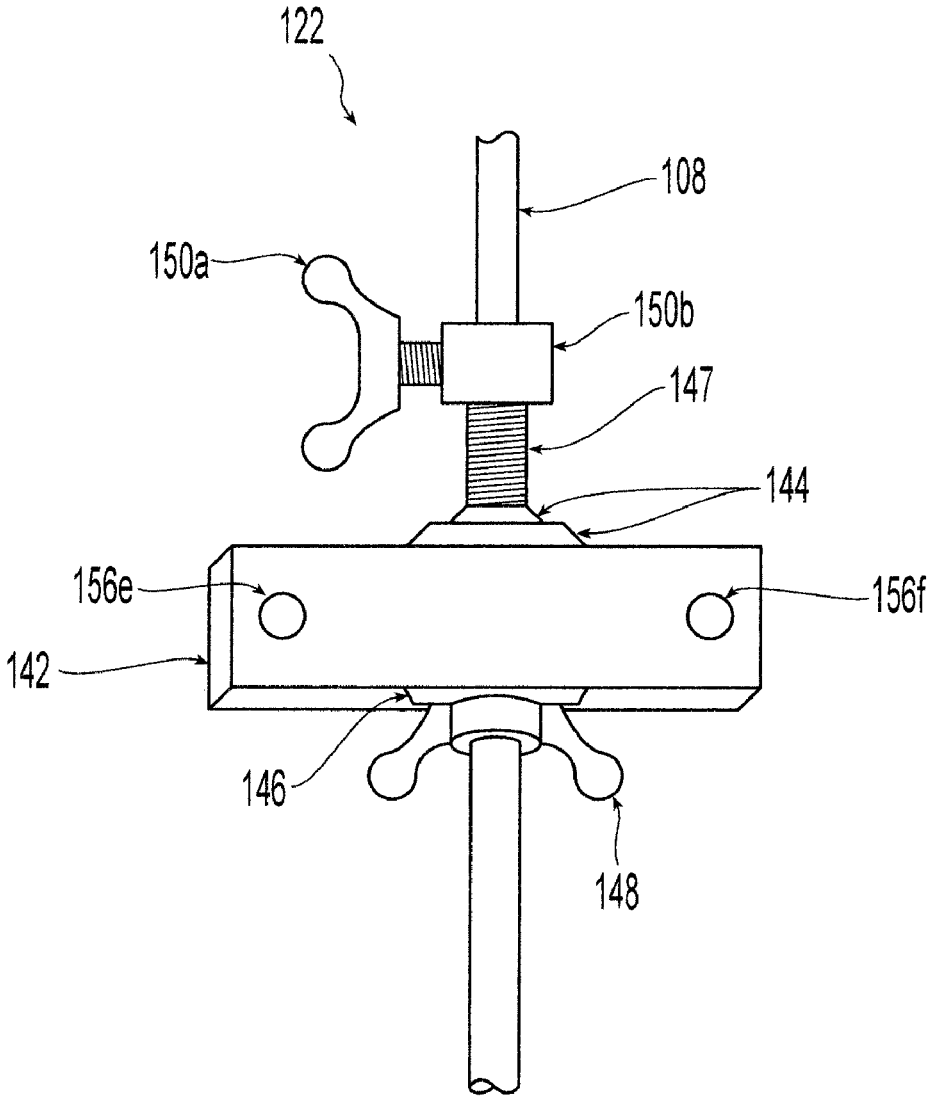

Referring to FIGS. 4A to 4C, the coupling of pivot portions 128, 129 to operating rod 108 will be described. Typically, in a hi-hat stand as previously described, a clutch is used proximate the top end of operating rod 108 to permit adjustment of the top cymbal. In the present invention, however, a clutch 140 is used to couple pivot portions 128, 129 to operating rod 108. In particular, a block or bar 142 with a central hole 142*a* therein is mounted between a pair of upper threaded washers 144 and a lower threaded washer 146 disposed on a threaded rod portion 147 of clutch 140. A first wing nut 148 may be threadably associated with threaded rod portion 147 and along with threaded washer 146 provides a lower boundary for bar 142. A thumb screw 150*a* is used for height adjustment of clutch 140 on operating rod 108. Preferably, sleeve 150*b* is threadably associated with threaded rod portion 147, and the threaded shaft of thumb screw 150*a* is threadably received in a circumferential hole in sleeve 150*b* and an end of the shaft may thus bear against operating rod 108. In particular, operating rod 108 is received in a through hole in clutch 140, and thus clutch 140 may be releasably fixed to operating rod 108.

Eyebolts 152, 154 are coupled to pivot portions 128, 129 by screwing threaded shafts of the eyebolts therein. The eyebolts 152, 154 are retained on bar 142, such as with another U-bolt 156 and nuts 156*a*, 156*b*, 156*c*, 156*d*. Eyebolts 152, 154, however, may freely rotate on U-bolt 156, so that when operating rod 108 moves downward along with bar 142, as accomplished for example by depressing pedal 106, the eyebolts 152, 154 may move downward with operating rod 108 while simultaneously rotating to bring arms 114, 116 closer together and thus crash cymbals 118, 120 into each other. U-bolt 156 is received in holes 156*e*, 156*f*. A one-quarter inch gap, for example, may be provided between nuts 156*a*, 156*b* and bar 142. to permit free rotation of eyebolts 152, 154 on U-bolt 156. It should be understood, however, that both eyebolts 152, 154 instead may be pivotable about a single pivot axis, such as defined by a shaft of a single bolt that may be coupled to bar 142.

Figure 5A:
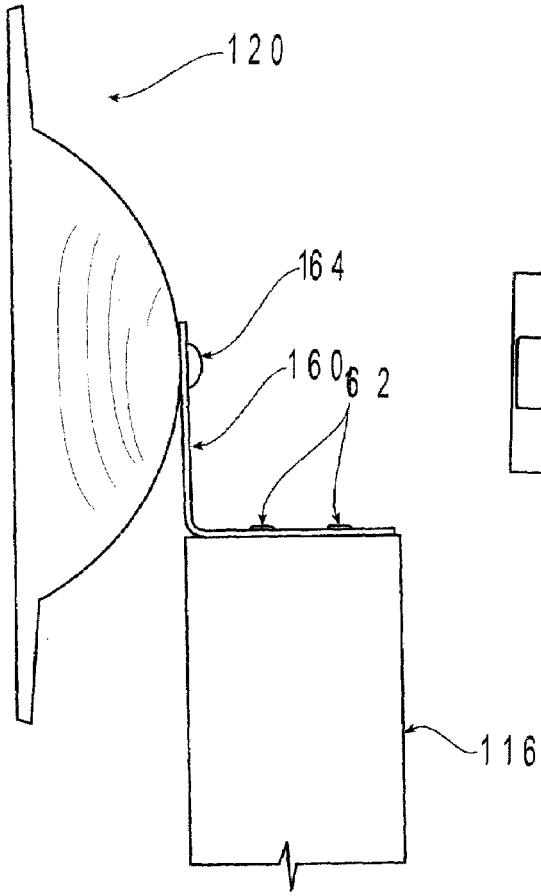
FIG. 5 shows the mounting of a cymbal on an arm of FIG. 2, including (5A) a side view, (5B) a top view, and (5C) a side view without a cymbal retained on an L-bracket.
Figure 5B:
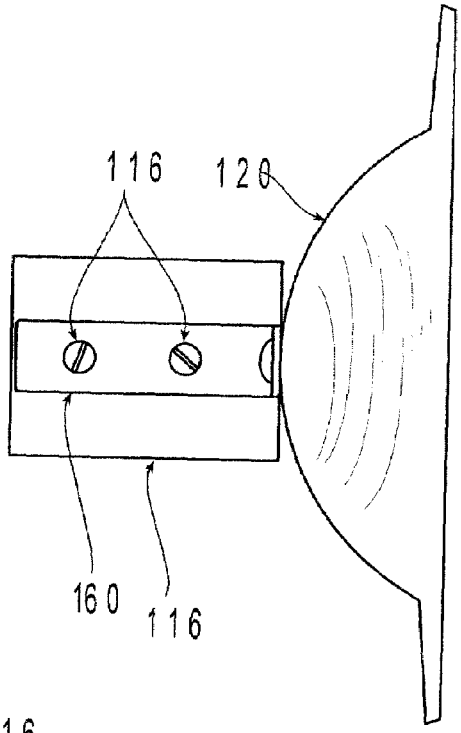
Figure 5C:
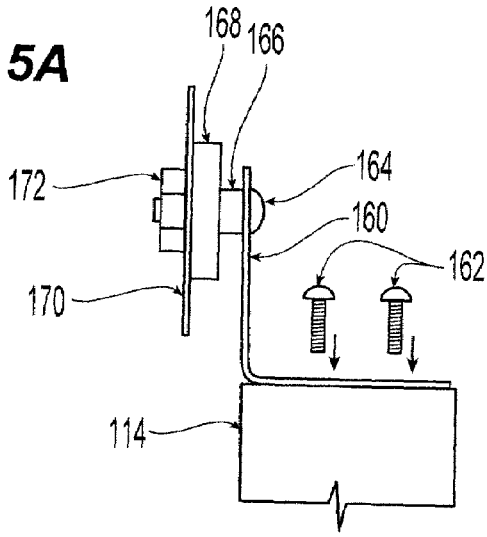

Next, referring to FIGS. 5A to 5C, the mounting of a cymbal 120 is shown, although the mounting also applies to cymbal 118. In particular, cymbal 120 is coupled to arm 116 using an L-bracket 160. Screws 162 may be used to fixedly attach a first extension of L-bracket 160 to arm 116. The cymbal 120 itself is coupled to a second extension of L-bracket 160 via a bolt 164 extending through a hole in the center of the cymbal. Cymbal 120 rests on a rubber washer 166. A felt washer 168 abuts a surface of the cymbal, and a metal washer 170 abuts the felt washer 168 so that the assembly is held together by nut 172 threadably engaged with bolt 164.

In one preferred embodiment, elastic retaining members 124, 126 are elastic bungee cords that are about 13 inches in length and about ⅜ inch in diameter. Support 110, for example, may be formed of 11/16 inch plywood.

In use, when pedal 106 is depressed by a user, operating rod 108 translates downward along axis 130, causing pivot portions 128, 129 to pivot with respect to support 110 and thus drawing cymbals 118, 120 toward one another to create a crash. When pressure is released from pedal 106, operating rod 108 may translate upward along axis 130, and elastic retaining members 124, 126 may cause pivot portions 128, 129 to rotate on support 110 so that cymbals 118, 120 are drawn apart.

Figure 6A:
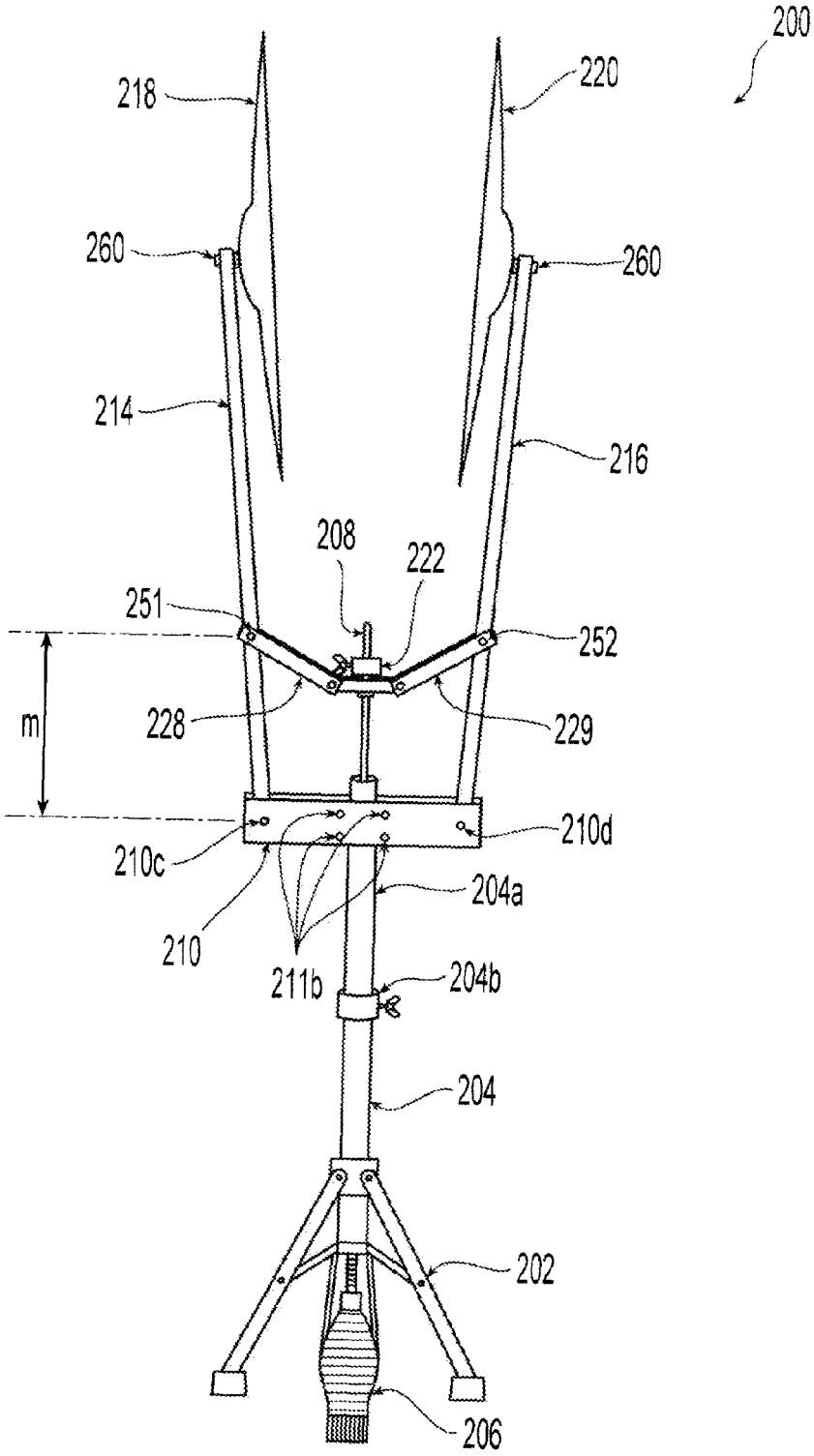
FIG. 6 shows a second embodiment of a cymbal assembly according to the present invention, including (6A) a front view, (6B) a partially exploded perspective view of a support, (6C) a partial perspective view of a clutch assembly, and (6D) a side view of a cymbal mount without a cymbal retained thereon.
Figure 6C:
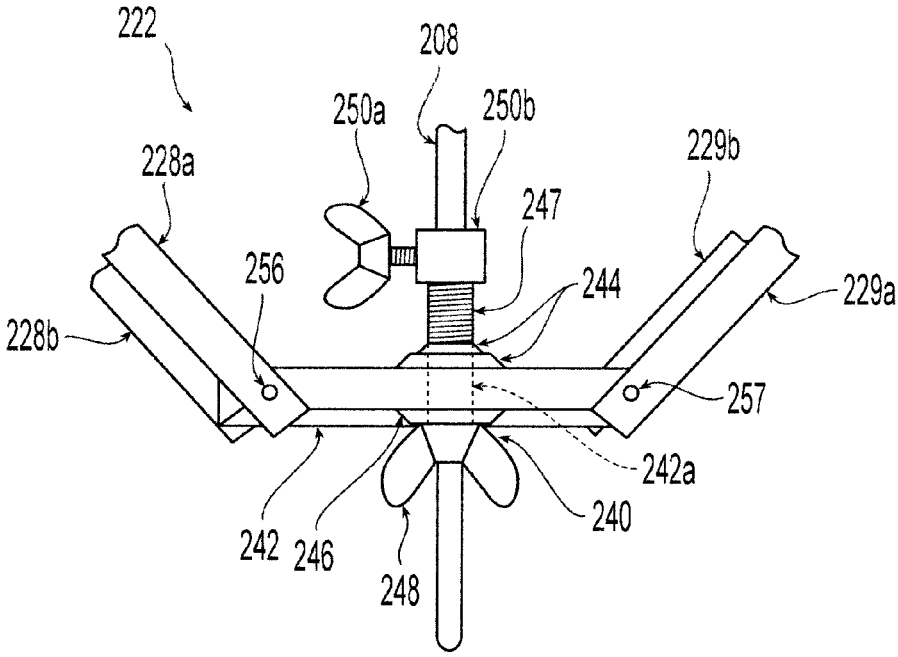
Figure 6B:
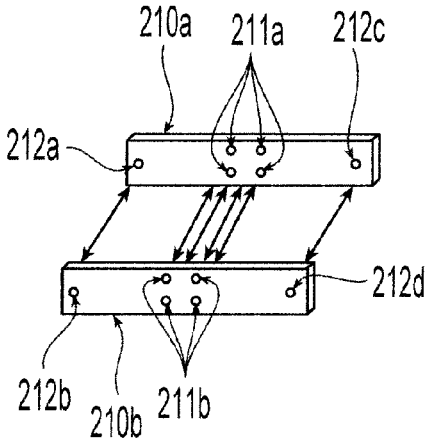

Turning next to FIGS. 6A-6D, another preferred exemplary embodiment of a cymbal assembly 200 according to the present invention is shown. Assembly 200 includes a stand 202 which may be in the form of a tripod, with an external stationary tube 204 coupled thereto. A foot pedal 206 is connected to the lower end of an operating rod 208, as known in the prior art and previously described. Operating rod 208 is coaxially and internally disposed with respect to stationary tube 204 as well as longitudinally slidable therein. Pedal 206 moves operating rod 208 up and down. A support 210 is coupled to tube 204*a* which telescopes in stationary tube 204 for adjusting the height of the apparatus, and in which operating rod 208 also is partially disposed. Collar 204*b* may be loosened or tightened to releasably set the height. Support 210 preferably is formed of a pair of generally rectangular shaped crossbars 210*a*, 210*b* that are coupled to each other with threaded bolts extending through aligned holes 211*a*, 211*b*, respectively, four of which have been generally centrally located in each crossbar. Crossbars 210*a*, 210*b* are coupled to tube 204*a* proximate an upper end thereof, and may be releasably and adjustably fixed thereto by compressing crossbars 210*a*, 210*b* toward each other while tube 204*a* is disposed therebetween as shown in FIG. 6A. In some embodiments, threaded bolts and wingnuts (not shown) may be used. In alternate embodiments, if crossbars 210*a*, 210*b* are formed of metallic material, they may be welded or otherwise metallically integrated with tube 204*a*.

A pair of arms 214, 216 are pivotably associated with support 210, as will be described below. Arms 214, 216 are disposed in a generally vertical fashion. Cymbals 218, 220 are coupled to arms 214, 216, respectively, proximate free ends thereof. Also, a coupling portion 222 is associated with arms 214, 216 and operating rod 208 to permit movement of cymbals 218, 220 with respect to each other.

Coupling portion 222 is in the form of a clutch block, similar to clutch 140. In particular, clutch 240 is used to couple pivot portions 228, 229 to operating rod 208. In particular, a block or bar 242 with a central hole 242*a* therein is mounted between a pair of upper threaded washers 244 and a lower threaded washer 246 disposed on a threaded rod portion 247 of clutch 240. A first wing nut 248 may be threadably associated with threaded rod portion 247 and along with threaded washer 246 for example may be used to provide a lower boundary for bar 242. A thumb screw 250*a* is used for height adjustment of clutch 240 on operating rod 208. Preferably, sleeve 250*b* is threadably associated with threaded rod portion 247, and the threaded shaft of thumb screw 250*a* is threadably received in a circumferential hole in sleeve 250*b* and an end of the shaft may thus bear against operating rod 208. In particular, operating rod 208 is received in a through hole in clutch 240, and thus clutch 240 may be releasably fixed to operating rod 208.

Pivot portions 228, 229 are pivotably connected to bar 242 proximate a free end of each pivot portion and may freely rotate about the smooth connection provided by a shaft running through bar 242. Pivot portions 228, 229 also are pivotably connected to arms 214, 216 by smooth connections at locations 251, 252, respectively, for example with bolts, as shown in FIG. 6A. When operating rod 208 moves downward along with bar 242, as accomplished for example by depressing pedal 206, pivot portions 228, 229 may move downward with operating rod 208 while simultaneously rotating to bring arms 214, 216 closer together and thus crash cymbals 218, 220 into each other. In one preferred exemplary embodiment, pivot portion 228 is formed of a pair of parallel segments 228*a*, 228*b* that are disposed on either side of bar 242 and pivotably associated therewith as by a bolt connection through coaxial holes at location 256. Similarly, pivot portion 229 is formed of a pair of parallel segments 229*a*, 229*b* that are disposed on either side of bar 242 and pivotably associated therewith as by a bolt connection through coaxial holes at location 257. Locations 256, 257 are proximate free ends of bar 242.

In order to provide stability to arms 214, 216 and to limit travel thereof, arms 214, 216 are pivotably connected by smooth connections proximate ends of support 210 at locations 210*c*, 210*d*. Coaxial hole pairs 212*a*, 212*b* and 212*c*, 212*d* may be provided in crossbars 210*a*, 210*b* for this purpose. In particular, arms 214, 216 may be disposed between crossbars 210*a*, 210*b* and pivotably coupled thereto. A bolt may run through hole pair 212*a*, 212*b* and a hole proximate an end of arm 214, and another bolt may run through hole pair 212*c*, 212*d* and a hole proximate an end of arm 216.

When pedal 206 is not depressed, the rigid but pivotable coupling of arms 214, 216 to operating rod 208 is such that arms 214, 216 remain spaced and biased apart from one another such that cymbals 218, 220 do not contact one another.

In some embodiments, the connections at holes 211*a*, 211*b* may be made for example using ¼-20×1.5 inch partially threaded hex head bolts and ¼-20 wingnuts, while the connections at locations 210*c*, 210*d* may be made for example using ¼-20×1.5 inch partially threaded hex head bolts and ¼-20 nylon insert lock nuts.

In some embodiments, crossbars 210*a*, 210*b* are formed of H.R. steel stock with a length of about 12 inches, a height of about 2 inches, and a thickness of about ⅛ inch. Arms 214, 216 may be formed of ¾ inch steel square tubing, 16 gauge, with a length of about 30 inches and a hole spacing m of about 10.5 inches. Bar 242 may be formed of ¾ inch steel square tubing with a length of about 4 inches, while pivot portions 228, 229 may be formed of H.R. steel stock with a length of about 6 inches, a height of about ¾ inch, and a thickness of about ⅛ inch.

Figure 6D:
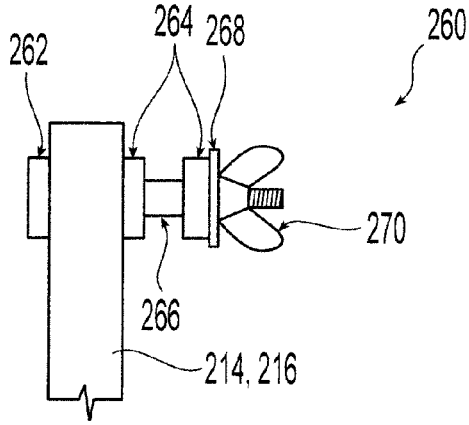

Finally, as shown in FIG. 6D, another preferred exemplary cymbal mount 260 of the present invention is shown. In particular, a bolt 262 extends through each arm 214, 216. In some embodiments, bolt 262 is a ¼-20×2 inch partially threaded hex head bolt. A pair of ¼ inch felt washers 264 are disposed on bolt 262 and spaced by a latex rubber sleeve 266 also disposed on bolt 262. A ¾ inch washer 268 and a ¼-20 wingnut 270 are disposed at the threaded end of bolt 262. Thus, a cymbal 218, 220 may be centrally supported on sleeve 266 on bolt 262, and releasably secured thereon by tightening wingnut 270.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. For example, elastic retaining members 124, 126 may be springs. In addition, although only two cymbals are shown in cymbal assembly 100, 200 other embodiments may include two or more pairs of cymbals which may be supported by arms 114, 116 or arms 214, 216, respectively, so that a greater "crash" sound may be created. Alternatively, pedal 106 or 206 may be linked such that multiple pairs of arms each disposed on a separate support 100 or 200, respectively, may be operated simultaneously. In some embodiments, linkage to activate cymbal movement may be disposed in aligned fashion with stationary tube 104, as shown in FIG. 2, or alternatively may be disposed remote from tube 104, known in the art as a remote control pedal. This similarly applies to the embodiment of FIGS. 6A-6D. Moreover, although each assembly 100, 200 supports a pair of cymbals as shown herein, each assembly 100, 200 instead may support other idiophones such as claves, sticks, a mallet or hammer and wood block, bell, or gong, or other pairs of objects that may be struck against one another. Preferably, the objects are rigid vibrators. In addition, although each assembly 100, 200 includes a stand 102, 202, respectively, in the form of a tripod, other support bases may be provided such as a wheeled base for permitting easy movement of assembly 100, 200 for example for use with a marching band. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A percussion instrument comprising:

a stand;

an operating rod defining a first axis;

a foot pedal operably associated with the operating rod for permitting movement of the operating rod along the first axis;

a pair of movable arms coupled to the stand;

a first rigid vibrator disposed on one of the arms and a second rigid vibrator disposed on the other of the arms;

a clutch coupled to the arms for governing movement thereof;

wherein the arms are rotatable toward each other and toward the first axis; and wherein the clutch is demountably attached to the operating rod.

2. The percussion instrument of claim 1, wherein the rigid vibrators are pivotable to contact each other proximate the first axis.

3. The percussion instrument of claim 2, wherein the first axis is generally vertical.

4. The percussion instrument of claim 1, wherein the rigid vibrators are mounted proximate ends of the arms.

5. The percussion instrument of claim 1, wherein the clutch is movable along the first axis to permit the arms to pivot with respect thereto.

6. The percussion instrument of claim 1, wherein the arms are coupled to the stand with elastic members.

7. The percussion instrument of claim 6, wherein the elastic members are elastic cords.

8. The percussion instrument of claim 1, wherein the stand comprises a tube through which the operating rod is received.

9. The percussion instrument of claim 8, wherein the movable arms are coupled to the tube.

10. The percussion instrument of claim 1, wherein the rigid vibrators are cymbals.

11. A percussion instrument comprising:

a stand comprising a tube;

an operating rod defining a generally vertical first axis, the operating rod received in the tube;

a foot pedal operably associated with the operating rod for permitting movement of the operating rod along the first axis;

a pair of movable arms coupled to the stand;

a first cymbal disposed on one of the arms and a second cymbal disposed on the other of the arms;

a clutch coupled to the arms for governing movement thereof;

a support fixed to the tube;

wherein the arms are pivotable toward each other and toward the first axis so that the cymbals are permitted to engage each other proximate the first axis; and wherein the arms are pivotable with respect to the support.

12. The percussion instrument of claim 11, further comprising a first elastic member for resisting movement of one of the movable arms toward the first axis and a second elastic member for resisting movement of the other of the movable arms toward the first axis.

13. The percussion instrument of claim 11, wherein the arms comprise first and second portions, the first portion pivotably coupled to the support and the second portion generally perpendicular to the first portion.

14. The percussion instrument of claim 11, wherein the clutch comprises at least one pivot axis and at least one arm is pivotable with respect to the at least one pivot axis.

15. A percussion instrument comprising:

a floor stand;

an operating rod defining a first axis;

a foot pedal for actuating movement of the operating rod along the first axis;

a pair of pivotable arms supported by the floor stand and each separately coupled thereto;

a cymbal coupled to each arm;

a first rigid member coupling one of the arms to the operating rod and a second rigid member coupling the other of the arms to the operating rod;

wherein the arms are coupled to the operating rod so that movement of the operating rod along the first axis permits pivotable movement of the arms toward each other and toward the first axis so that the cymbals are permitted to engage each other.

16. The percussion instrument of claim 15, wherein the foot pedal is operable in a first direction for moving the operating rod to move the cymbals toward one another, and the foot pedal is movable in a second direction opposite from the first direction for moving the operating rod to move the cymbals away from one another.

17. The percussion instrument of claim 15, wherein the arms are biased away from each another.

18. The percussion instrument of claim 1, wherein the arms are coupled to the operating rod with rigid members.

19. The percussion instrument of claim 1, wherein the arms are rotatable toward each other and toward the first axis so that the rigid vibrators are permitted to contact each other proximate the first axis.

20. The percussion instrument of claim 15, wherein the floor stand comprises a support member and the arms are coupled to the support member.

21. The percussion instrument of claim 15, further comprising a clutch coupled to the arms and demountably attached to the operating rod for governing movement of the arms.

* * * * *